United States Patent [19]

Tokunaga et al.

[11] 4,427,755

[45] Jan. 24, 1984

[54] METHOD FOR TRANSFERRING TONER IMAGES IN ELECTROPHOTOGRAPHY

[75] Inventors: Kazuyoshi Tokunaga, Katsuta; Masayasu Anzai, Hitachi, both of Japan

[73] Assignees: Hitachi, Ltd.; Hitachi Koki Co., Ltd., both of Tokyo, Japan

[21] Appl. No.: 56,359

[22] Filed: Jul. 10, 1979

[30] Foreign Application Priority Data

Jul. 21, 1978 [JP] Japan ..... 53-88396

[51] Int. Cl.[3] ..... G03G 15/00

[52] U.S. Cl. ..... 430/97; 430/126; 430/125

[58] Field of Search ..... 430/97, 100, 126, 125

[56] References Cited

U.S. PATENT DOCUMENTS

| | | | |
|---|---|---|---|
| 2,914,403 | 11/1959 | Sugarman | 430/126 |
| 3,764,207 | 10/1973 | Obuchi | 430/126 |
| 3,843,381 | 10/1974 | Matsumoto et al. | 430/126 |
| 3,888,664 | 6/1975 | Carlson et al. | 430/97 |

*Primary Examiner*—John E. Kittle
*Assistant Examiner*—John L. Goodrow
*Attorney, Agent, or Firm*—Antonelli, Terry & Wands

[57] ABSTRACT

In a method for electrophotography comprising an electrostatic transfer process, after an electrostatic latent image formed on a surface of a photoconductive and photosensitive member has been developed with toner, the surface of the photoconductive and photosensitive member and a toner image are charged at the same polarity as the electrostatic latent image and thereafter the toner image is electrostatically transferred onto a recording medium to obtain a record.

6 Claims, 7 Drawing Figures

METHOD FOR TRANSFERRING TONER IMAGES IN ELECTROPHOTOGRAPHY

BACKGROUND OF THE INVENTION

1. Field of the Invention

This invention relates generally to electrophotography and more particularly, to a method for electrophotography wherein after an electrostatic latent image formed on a surface of a photoconductive and photosensitive member has been developed with toner, a toner image is transferred onto a recording medium.

2. Description of the Prior Art

According to a known method of electrophotography, a surface of a photoconductive and photosensitive member is uniformly charged, the uniformly charged surface of the photosensitive member is exposed to an imaging light to form a latent image of electric charge on the surface, and the latent image of electric charge is developed with toner. In such an electrophotography, for repetitious use of the photoconductive and photosensitive member, it is general to transfer the toner image formed on the surface of the photoconductive and photosensitive member onto the recording medium (recording paper). In some applications such as reproducing a positive image from a negative image, recording character information displayed on a cathode ray tube (CRT) or laser beam printing, use is made of reversal characteristics wherein the surface of the photoconductive and photosensitive member is deposited with toner at regions where electric charge are struck off by being exposed to light.

The electrophotography utilizing reversal and transfer techniques is carried out as follows. A photoconductive and photosensitive member is charged from a corona charger to uniformly provide positive charge over its surface (uniform charging process). The photoconductive and photosensitive member thus charged uniformly over its surface is then exposed to an imaging light through an optical system and loses its charge to form a latent image of electric charge (imaging light exposure process). The photoconductive and photosensitive member formed with the latent image of electric charge is then subjected to reversal (developing process). A device for reversal has a magnetic roller whose surface is applied with a magnetic brush constituted by a developer which contains a magnetic carrier and a toner, the toner being charged with electric charge of the same polarity (positive) as the electric charge forming the latent image. When the magnetic brush softly rubs against the surface of the photoconductive and photosensitive member, the toner is deposited on the regions of the photosensitive member surface where electric charge has been struck off (reversal process), thereby forming a toner image. A recording medium is then placed on the surface of the photoconductive and photosensitive member and a transfer field is applied on the back of the recording medium from a corona charger. The transfer field applies negative charge on the back since the toner image is of positive charge. Finally, the recording medium is separated from the surface of the photoconductive and photosensitive member with the toner image transferred onto the surface of the recording medium (transfer process).

Where it is desired to form again an image on the same photoconductive and photosensitive member, there is incorporated an additional process for erasing the latent image charge and the remaining toner image as well.

In general, repetitions and prolonged use of the photoconductive and photosensitive member is responsible for tendency toward degraded characteristic (wear) of the photosensitive member. This wear found expression in a problem which faces not only an increased residual potential wherein the surface potential will not decrease below a certain level even with an increased exposure but also an aggravated dark decay wherein the sustaining rate for the surface potential is decreased even in the dark owing to an increased dark current.

SUMMARY OF THE INVENTION

Object of the Invention

This invention has for its prime object to provide a method for electrophotography which can prevent wear of the photoconductive and photosensitive member subject to repetitious use and which can improve transfer efficiency of the toner image.

SUMMARY OF THE INVENTION

The inventors of the present application found through experiments and discussions on behavior of wear in the photoconductive and photosensitive member that the photoconductive and photosensitive member considerably wears by being charged oppositely to its latent image charge during the electrostatic transfer process. Especially, it was confirmed that once charged oppositely, the photoconductive and photosensitive member becomes extremely increased in its dark decay. Accordingly, the photoconductive and photosensitive member was affected disadvantageously by the opposite polarity charging during the transfer process so that the transfer field needed to be minimized. Minimization of the transfer field was, however, conventionally contradictory to maintenance of recording density on the recording medium since the tone image transfer efficiency decreases and residual toner increases, thus reducing the recording density.

In accordance with a feature of this invention, after an electrostatic latent image formed on a surface of a photoconductive and photosensitive member has been developed with toner, the surface of the photoconductive and photosensitive member and a toner image are charged at the same polarity as the electrostatic latent image and thereafter the toner image is electrostatically transferred onto a recording medium, whereby the photoconductive and photosensitive member can be prevented from being charged oppositely to thereby prevent wear of the photosensitive member and in addition, the toner can be charged intensively to improve transfer efficiency of the toner image.

BRIEF DESCRIPTION OF THE DRAWINGS

FIGS. 1A to 1F are diagrams to show a flow of processes implementing a method for electrophotography in accordance with the invention, of which FIG. 1A shows a uniform charge process, FIG. 1B an imaging light exposure process, FIG. 1C a developing process, FIG. 1D a uniform exposure process, FIG. 1E a recharging process, and FIG. 1F a transfer process.

DETAILED DESCRIPTION OF THE PREFERRED EMBODIMENTS

Figure 1A:
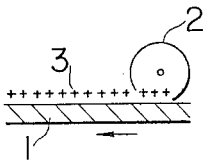
Figure 1B:
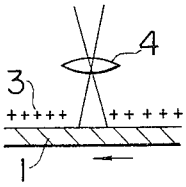
Figure 1C:
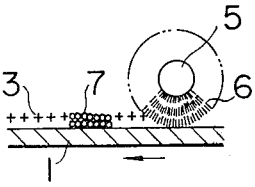
Figure 1D:
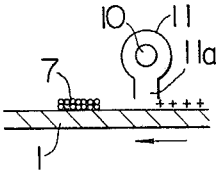
Figure 1E:
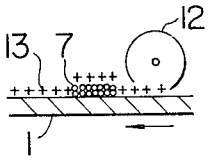
Figure 1F:
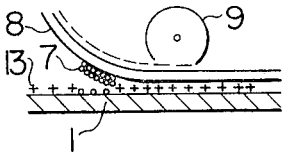

With reference to FIGS. 1A to 1F, a flow of processes of an electrophotography implementing this invention will be described. FIG. 1A shows a uniform charge process wherein a photoconductive and photosensitive member 1 is charged from a corona charger 2 and positive charges 3 are applied uniformly over a surface of the photosensitive member. FIG. 1B shows an imaging light exposure process wherein the photoconductive and photosensitive member 1 whose surface has been charged uniformly is exposed to an imaging light through an optical system 4. In this phase, the charges 3 on the surface of the photoconductive and photosensitive member are struck off in accordance with the amount of exposure to form a latent image of electric charge on the surface of the photoconductive and photosensitive member 1. FIG. 1C shows a reversal process. A magnetic roller 5 has on its surface a magnetic brush 6 constituted by a developer which contains a magnetic carrier and a toner, the toner being charged with electric charge of the same polarity (positive) as the electric charge forming the latent image. When tip of the magnetic brush 6 softly rubs against the surface of the photoconductive and photosensitive member 1, the toner is deposited on a region of the photosensitive member surface where electric charge has been struck off, thereby forming a toner image 7 (completion of reversal). Residual positive charges 3 on unexposed regions have been partly discharged from the surface of the photoconductive and photosensitive member 1 into the carrier of the magnetic brush 6 during the developing process. As a result, the surface potential (charge) on the photoconductive and photosensitive member after the toner development distributes irregularly. If a sufficiently intensive recharge is conducted under the irregular distribution, an excessive charging will occur locally, giving rise to possible damage of the photoconductive and photosensitive member 1. Accordingly, in the embodied electrophotography process of this invention, a uniform exposure is carried out, as shown in FIG. 1D, following the developing process, by using a light source lamp 10 which is housed in a lamp cover 11 having an exposure window 11A. By virtue of this uniform exposure, the residual charge on the surface of the photoconductive and photosensitive member 1 can be erased. Next, as shown in FIG. 1E, the surface of the photoconductive and photosensitive member 1 and the toner image 7 are uniformly recharged, shown in FIG. 1E at 13, from a corona charger 12 at the same polarity (positive) as the initial uniform charge. A minimum amount of recharge to be applied on the photoconductive and photosensitive member 1 is so determined as to prevent the photoconductive and photosensitive member 1 from being charged with opposite polarity leakage charge (of an amount which is possible to accelerate the wear phenomenon) during the application of the transfer field in the subsequent transfer process. At this time, due to the nature of the toner feasible to being charged positively (for the sake of reversal), the toner image 7 itself can stably accept the positive charge 13. Subsequently, as shown in FIG. 1F, a recording medium 8 is brought into contact with the surface of the photoconductive and photosensitive member 1 and transfer field is applied on the back of the recording medium from a corona charger 9 to thereby transfer the toner image 7 onto the surface of the recording medium 8 with high efficiency. Although the back of the recording medium 8 is charged at an opposite polarity to that of the toner image charge, the surface of the photoconductive and photosensitive member 1 which has already been charged with electric charge of the initial polarity will not be charged intensively at the opposite polarity but will be partly neutralized, at the most, by the leakage charge. Thus, simultaneous improvements in both the transfer efficiency and wear prevention can be attained.

The toner image 7 carried by the recording medium 8 is subsequently fixed by known thermal fixing means.

Figure 2:
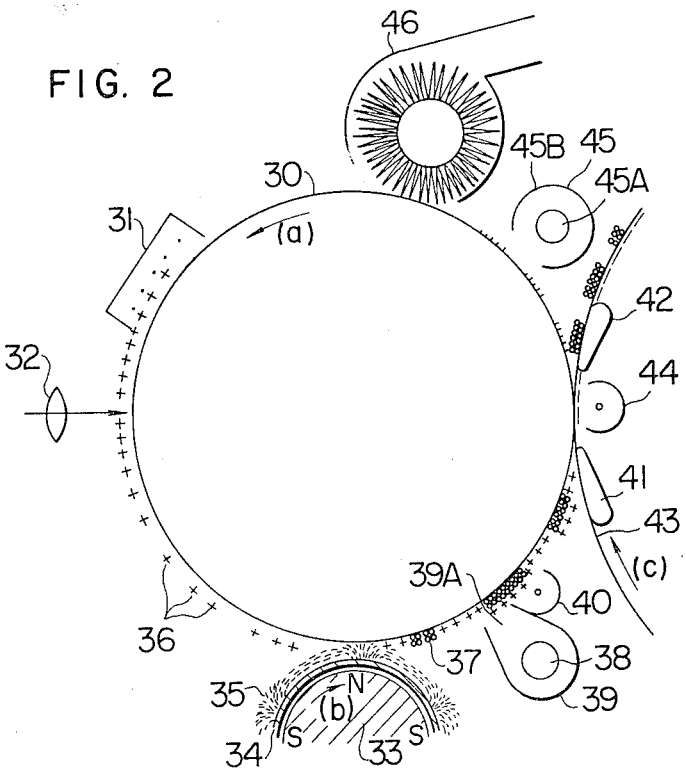
FIG. 2 is a schematic diagram of an electrophotographic apparatus incorporating the method of the invention.

FIG. 2 shows exemplarily an electrophotographic apparatus implementing the method of this invention. The apparatus comprises a photosensitive drum 30 having a photoconductive treatment surface coating (selenium layer) and being rotatable in the direction of the arrow (a), a corona charger 31 which discharges corona for uniformly charging the surface of the photosensitive drum 30 with positive electric charge, an imaging light optical system 32 which exposes the surface of the photosensitive drum 30 to an imaging light to form thereon an electrostatic latent image, a magnetic roller 33 with an outer non-magnetic sleeve 34 which is rotatably mounted thereon and which has on its surface a magnetic brush 35 constituted by a developer whereby the non-magnetic sleeve 34 rotates in the direction of the arrow (b) to cause the tip of the magnetic brush 35 to softly rub the surface of the magnetic drum 30 so that a charge struck off region 36 is deposited with toner to form a toner image 37, a light source lamp 38 uniformly exposing the surface of the photosensitive drum 30 to erase the residual charge, the lamp 38 being housed in a cover 39 having an exposure window 39A, a corona charger 40 adapted to recharge the photosensitive drum 30 and toner image 37 with positive charge, guide means 41 and 42 for guiding and driving a recording medium (plain paper) 43 in such a manner that the recording medium 43 is driven at a synchronizing speed in a direction by arrow (c) while making temporary contact to the surface of the photosensitive drum 30, a corona charger 44 for applying transfer field of negative polarity, a charge eraser 45 which erases charge on the surface of the photosensitive drum 30 to permit reuse of the same, the eraser 45 including a light source lamp 45A and a cover 45B, and residual toner cleaning means 46.

With the above construction, the surface of the photosensitive drum 1 is charged uniformly at positive polarity from the corona charger 31. The surface of the photosensitive drum 1 thus charged uniformly is then exposed to an imaging light through the optical system 32 to form an electrostatic latent image and further subjected to reversal by means of the magnetic brush 35. The light source lamp 38 uniformly exposes the surface of the photosensitive drum 1 on which the toner image 37 is formed and erases residual irregular charge remaining on the surface after the development. After the surface potential has been made uniform in this manner, the surface of the photosensitive drum 30 is recharged uniformly at a positive polarity from the corona charger 40. The toner image 37 is also recharged at positive polarity. Thereafter, the surface of the photosensitive drum 30 comes in contact with the recording medium 43 and the back of the recording medium 43 is charged at negative polarity for transfer from the corona charger 44. The recording medium 43 is then separated from the surface of the photosensitive drum 30 while the toner image 37 on the photosensitive drum 30 is transferred onto the surface of the recording medium 43 on the basis of an electrostatic force. After the transfer has been completed, the surface of the photosensitive drum 30 is uniformly exposed to light from the lamp 45 to erase the residual charge and then cleaned by the toner cleaning means 46. The photosensitive drum 30 is now ready for reuse. The toner image 37 transferred onto the recording medium 43 is heated and thermally fixed.

While, in the foregoing description, the photosensitive drum 30 has been charged uniformly at positive polarity, it may be charged at negative polarity with corona chargers of opposite polarity, together with charging the toner oppositely.

As described above, according to the invention, the recharge following development but preceding transfer can improve the transfer efficiency and alleviate wear of the photoconductive and photosensitive member.

What is claimed is:

1. In a method for electrophotography wherein a surface of a photoconductive and photosensitive member is uniformly charged with one polarity, exposed to an imaging light and subjected to development with toner charged with the same polarity as the photoconductive and photosensitive member, to form a toner image on the surface of said photoconductive and photosensitive member, and thereafter a surface of a recording medium is brought into contact with the surface of said photoconductive and photosensitive member on which the toner image has been formed and a transfer bias field is applied on the back of said recording medium to transfer the toner image onto the surface of said recording medium, the improvement which comprises the steps of erasing residual charge on the surface of said photoconductive and photosensitive member after said toner development, recharging the surface of said photoconductive and photosensitive member and the toner image at the same polarity as said uniform charging, and electrostatically transferring the toner image onto the surface of said recording medium with a transfer bias field having a polarity opposite to that of said polarity of said photoconductive and photosensitive member.

2. An electrophotographic method according to claim 1 wherein said imaging light exposure and toner development are of reversal characteristic.

3. An electrophotographic method according to claim 1 wherein said erasing the residual charge comprises exposing the surface of said photoconductive and photosensitive member to light uniformly.

4. In a method for electrophotography wherein a surface of a photoconductive and photosensitive member is uniformly charged with one polarity, exposed to an imaging light and subjected to reversal development with toner charged with the same polarity as said photoconductive and photosensitive member, to form a toner image on the surface of said photoconductive and photosensitive member, and thereafter a surface of a recording medium is brought into contact with the surface of said photoconductive and photosensitive member on which the toner image has been formed and the toner image is transferred onto the surface of said recording medium, the improvement wherein the surface of said photoconductive and photosensitive member is uniformly exposed to light after said reversal development with toner to erase a residual irregular charge remaining on the surface after said development, the surface of said photoconductive and photosensitive member and the toner image are recharged uniformly at the same polarity as said uniform charging of said photoconductive and photosensitive member, and thereafter a surface of a recording medium is brought into contact with the surface of said photoconductive and photosensitive member on which the toner image has been formed and the back of said recording medium is charged with the transfer bias charge of an opposite polarity to that of said uniform charging so as to electrically transfer the toner image onto the surface of said recording medium.

5. An electrophotographic method according to claim 4, wherein said transfer charge is supplied by a corona charger.

6. An electrophotographic method according to claim 4, wherein said improvement further comprises heating the toner image on the surface of said recording medium to thermally fix the toner image onto the recording medium, exposing the photoconductive and photosensitive member, after transfer of the toner image has been completed, to light to erase residual charge and then cleaning the member to remove any residual toner.

* * * * *